United States Patent [19]

Retallick

[11] 4,397,356

[45] Aug. 9, 1983

[54] HIGH PRESSURE COMBUSTOR FOR GENERATING STEAM DOWNHOLE

[76] Inventor: William B. Retallick, 1432 Johnny's Way, West Chester, Pa. 19380

[21] Appl. No.: 247,918

[22] Filed: Mar. 26, 1981

[51] Int. Cl.[3] ..... E21B 43/24

[52] U.S. Cl. ..... 166/303; 166/59; 431/4; 431/7; 431/170; 60/39.55; 60/723; 122/4 D; 122/31 R

[58] Field of Search ..... 431/4, 7, 170, 190; 60/723, 39.55; 252/477 R; 110/215; 122/4 D, 31 R; 166/59, 302, 57, 58, 303, 272, 256; 175/17, 14

[56] References Cited

U.S. PATENT DOCUMENTS

| | | | |
|---|---|---|---|
| 2,734,578 | 2/1952 | Walter | 166/57 |
| 3,397,154 | 8/1968 | Talsma | 423/213.2 |
| 3,857,668 | 12/1974 | Koch | 431/7 |
| 4,072,007 | 2/1978 | Sanday | 60/723 |
| 4,078,613 | 3/1978 | Hamrick et al. | 166/302 |
| 4,154,568 | 5/1979 | Kendall et al. | 431/7 |

*Primary Examiner*—James A. Leppink
*Assistant Examiner*—Hoang C. Dang
*Attorney, Agent, or Firm*—Paul & Paul

[57] ABSTRACT

A catalytic combustor for generating a mixture of steam and combustion gas is located downhole in an oil well, so that the gas mixture can be injected directly into the oil reservoir to displace heavy oils from the reservoir. There can be a single stage of catalytic combustion, or there can be a stage of thermal combustion followed by a catalytic stage. In either case the purpose of the catalyst is to drive the combustion to completion so that the gas mixture contains no soot that would plug the face of the reservoir.

15 Claims, 3 Drawing Figures

HIGH PRESSURE COMBUSTOR FOR GENERATING STEAM DOWNHOLE

BACKGROUND OF THE INVENTION

This invention relates to a combustor for generating steam downhole in an oil reservoir. By "downhole" it is meant that the steam is generated at or near the bottom of the oil well. The steam is injected into the reservoir to displace heavy oil. The steam injected in this manner forces oil out of the reservoir and into other oil wells located nearby. In the first attempts to do this, the steam was generated at ground level and fed to the reservoir through a pipe that extended down the oil well to the reservoir. This method is limited to depths of 3000 feet or less because too much of the steam condenses during the long passage down the well to the reservoir.

One object of Project Deep Steam, sponsored by the U.S. Department of Energy, is to develop a downhole steam generator. Two types of downhole combustor are being developed. The first is a low pressure combustor, wherein the heat from combustion is transferred to boiling water through the metal wall of a heat exchanger. The combustion gas is vented to ground level. The second type is a high pressure combustor wherein water is vaporized directly into the hot combustion gas, and the mixture of combustion gas and steam is injected into the reservoir. This is a high pressure generator because the combustion must take place at the high pressure necessary to force the mixture into the reservoir. The present invention relates to high pressure steam generators.

One example of a downhole catalytic combustor is found in my copending U.S. patent application, Ser. No. 208,674, filed Nov. 20, 1980, entitled "Dowhole Steam Generating Process." Another example of the use of catalytic combustion is found in my copending U.S. patent application, Ser. No. 145,597, filed May 1, 1980, entitled "Catalytic Heater."

SUMMARY OF THE INVENTION

The high pressure combustor of the present invention comprises a chamber wherein a flame is produced, and into which water is directed. The water is vaporized by the combustion, and the mixture of steam and combustion gas is forced through a catalyst support which is coated with a suitable catalyst. The catalyst causes the combustion to continue to completion, without the formation of soot. Additional water may be directed into the combustor, at a location where the steam and combustion gas leave the catalyst support. This additional water acts both to produce more steam, and to cool the product steam to the desired temperature. The steam can be injected directly into the oil reservoir.

It is an object of the invention to provide a catalytic combustor for generating a mixture of steam and combustion gas downhole in an oil well so that the mixture can be injected directly into the oil reservoir.

It is another object to provide a combustor having a stage of thermal combustion followed by a catalytic stage wherein soot and the precursors of soot are burned completely.

It is another object to provide a catalytic combustor that can burn heavy liquid fuels without forming soot.

It is another object to provide a combustor having a catalytic stage wherein the catalyst support is a metal honeycomb that can be welded in place and that cannot shatter from thermal shock.

Other objects and advantages of the invention will be apparent to persons skilled in the art, from a reading of the following brief description of the drawings, the detailed description of the invention, and the appended claims.

DETAILED DESCRIPTION OF THE INVENTION

Figure 1:
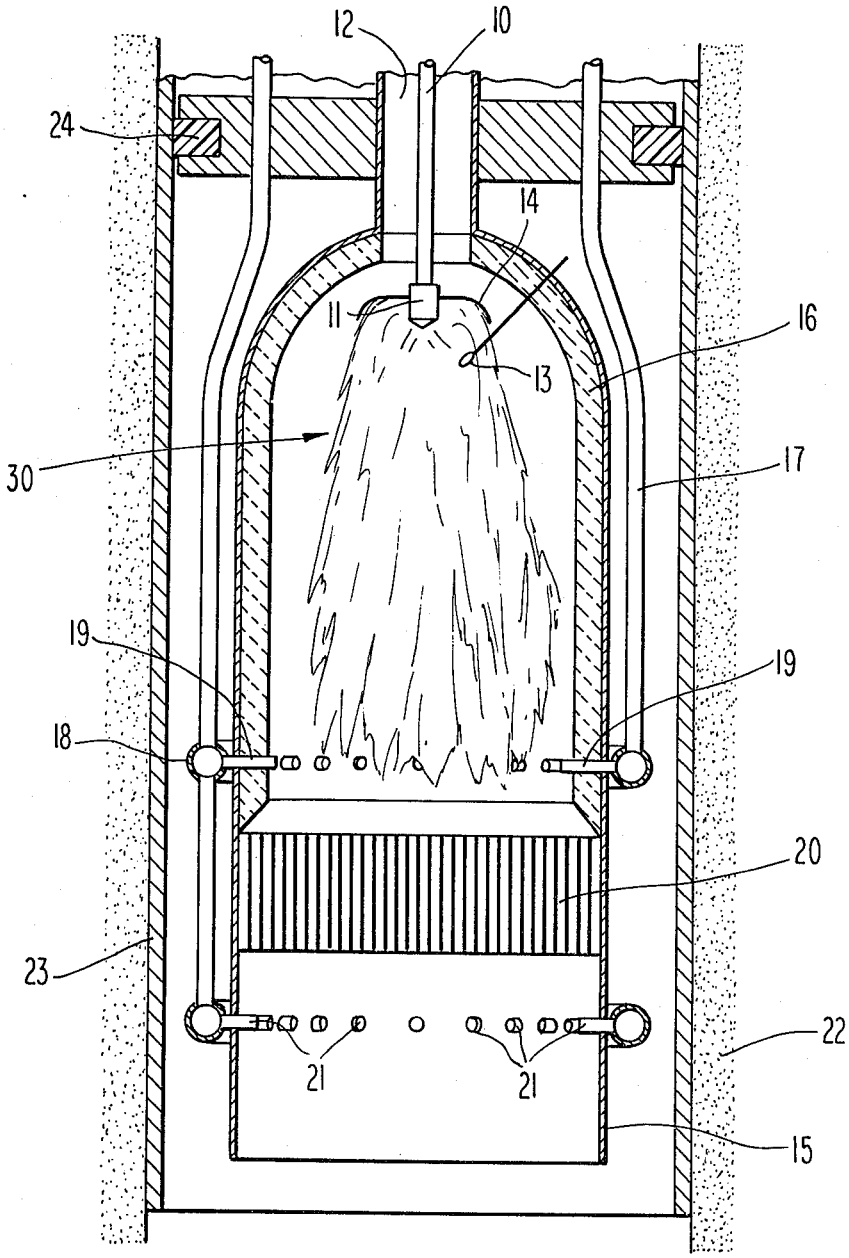
FIG. 1 is a cross-sectional view of the high pressure catalytic combustor.

FIG. 1 is a cross-sectional view of a high pressure steam generator assembled downhole in an oil well. Liquid or gaseous fuel enters through fuel duct 10 and injector nozzle 11, and mixes with air that enters through tube 12. The glow plug 13 can be used to ignite the fuel-air mixture. Alternatively, the combustion can be started by preceding the gaseous or oil fuel with a hypergolic fuel that ignites spontaneously upon contact with air. Flame holder 14 anchors the flame in the position shown and prevents the flame from blowing out. The shell 15 of the steam generator has a refractory lining 16 along most of the boundary of combustion chamber 30. Water enters through duct 17, donut ring manifold 18, and nozzles 19 spaced around the circumference of combustion chamber 30. There can be several rings of water nozzles spaced along the length of the combustion chamber. The water spray is vaporized by the hot combustion gases to form a mixture of combustion gas and steam. The mixture passes through a catalyst support, in the form of honeycomb 20. This honeycomb, which is of conventional construction, comprises a plurality of generally parallel slots, allowing gas to pass directly through. The honeycomb, which may be of ceramic or of metal, is coated with a catalyst appropriate to carry the combustion to completion.

Below the catalyst honeycomb there is another ring of water nozzles 21. Additional water is sprayed in through nozzles 21 to generate more steam, and to reduce the temperature of the outgoing mixture of combustion gas and steam to about 600°-800° F. This mixture is forced into the sand formation 22 of the oil reservoir. The oil well casing 23 is cemented into the formation 22 in a conventional manner, and a pressure seal between the steam generator and the casing is formed by packing 24. The embodiment thus comprises nozzles 19 located upstream of honeycomb 20, as well as nozzles 21 located downstream of honeycomb 20, as shown in FIG. 1.

As stated above, the catalyst honeycomb 20 can be of metal or ceramic. Metal is preferred because it can be welded in place and because it cannot shatter from thermal shock.

Figure 2:
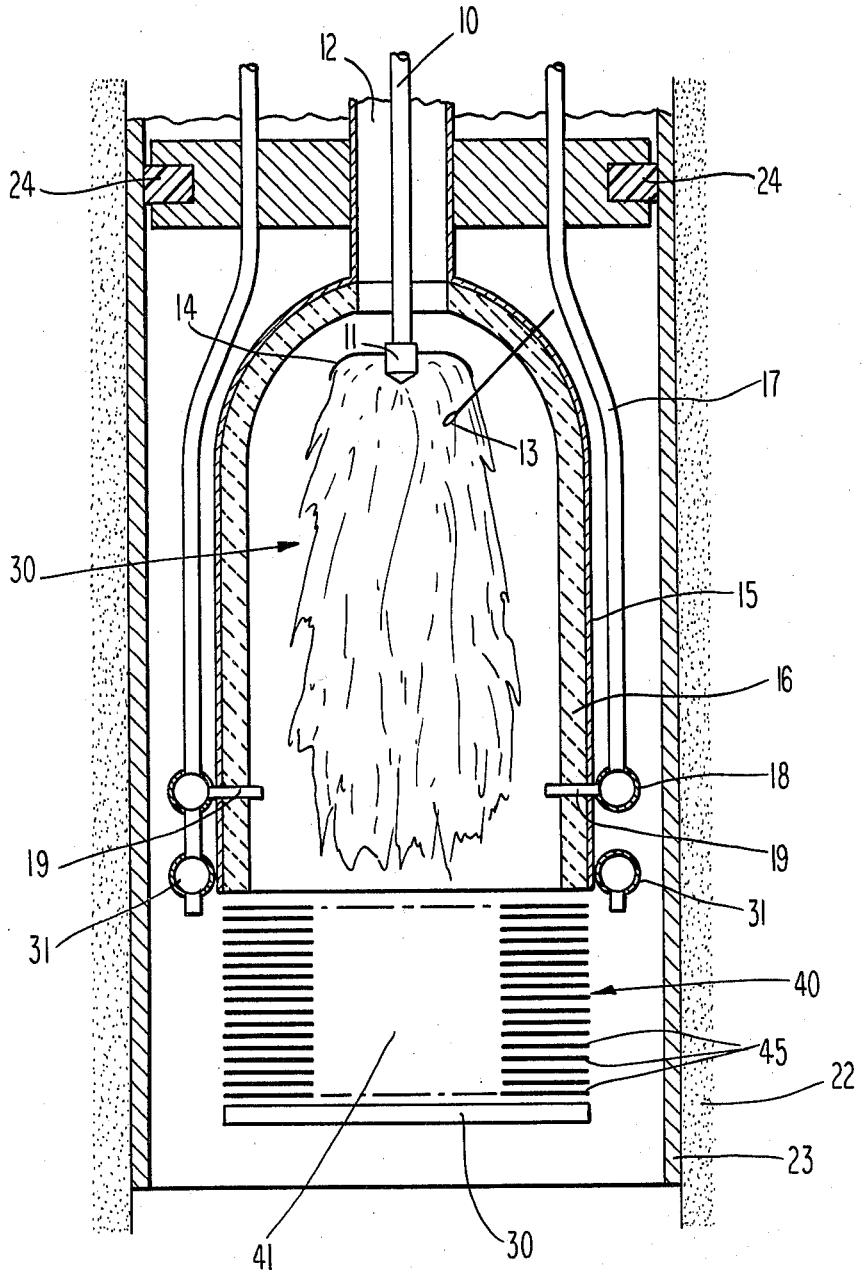
FIG. 2 is a cross-sectional view of another embodiment of the high pressure catalytic combustor according to the invention.

FIG. 2 shows another embodiment of the invention. This embodiment is similar to that of FIG. 1 except that the catalyst support has a different configuration. Here the catalyst support 40 is a stack of rings 45 cut from sheet metal. These rings each have a central hole, and the central holes of all the rings together define central core 41. The gas mixture enters the core 41 of the stack and flows radially outward through the spaces between the rings 45. The bottom end of core 41 is covered by cover 30. The nozzles 31 spray water into the gas emerging from between the rings, and are entirely analogous to nozzles 21 in FIG. 1. The spacing between the rings can be maintained by indentations made in the rings (not shown in FIG. 2). Indentations of a suitable shape are described in my U.S. Pat. Nos. 4,162,993 and 4,190,559.

The main purpose of the catalyst is to produce a mixture of combustion gas and steam that contains no soot. Any soot in the gas mixture is filtered out on the face of the sand formation 22, where it gradually plugs the formation. Soot is especially likely to form with heavy liquid fuels. There is an incentive to burn heavier liquids because they are cheaper. The incentive is great because fully one barrel of oil must be burned to displace three barrels from the reservoir.

Soot results from incomplete combustion. The usual reason for using a catalyst to promote combustion is to drive the combustion to completion, and so to remove pollutants from the combustion gas. As stated above, the pollutant which must be most often removed is soot, or the heavy molecules that are the precursors of soot. The temperature in the catalyst must be high enough to burn the soot, or the precursors of soot. The temperature of the gas that enters the catalyst honeycomb is determined by the division of the water between the upper and the lower nozzles. The temperature increases as more of the water is diverted to the lower nozzles.

There is another way to operate the combustor. If the fuel is a gas or a distillate, and all of the water is injected through the lower nozzles (21 or 31), there is no need for a flame in the mixing chamber above the catalyst, but instead all of the combustion can occur within the catalyst honeycomb. Of course, a conventional means of starting the combustion, such as glow plug 13, is needed.

In this mode of operation, fuel is injected into the apparatus, and the fuel is ignited by the glow plug or other ignition means. Then, the flow of fuel is momentarily cut off, thereby extinguishing the flame. Next, the flow of fuel is resumed, though of course there is now no flame. The heat previously generated in the catalyst honeycomb radiates outward, into the combustion chamber 30, pre-heating the fuel-air mixture. The combustion can then be completed catalytically, without a flame.

Figure 3:
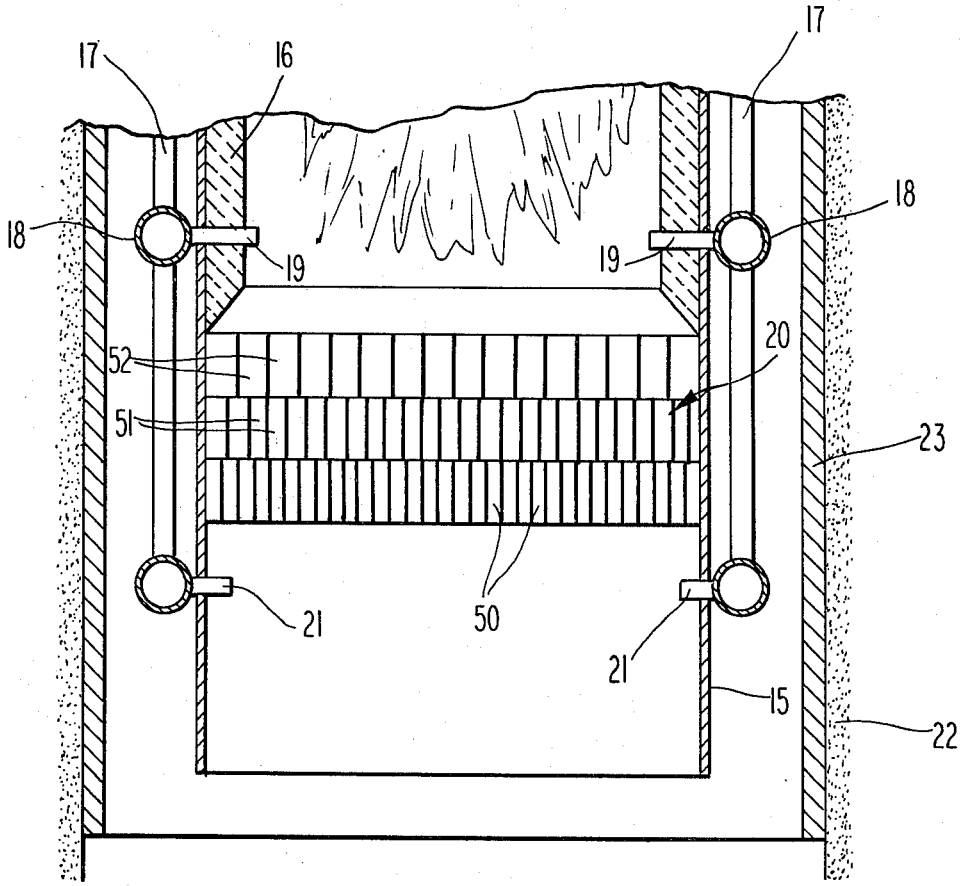
FIG. 3 is a fragmentary cross-sectional view of another embodiment, showing a catalyst support having cells whose size increases in the upstream direction.

An alternative embodiment of the present invention is shown in FIG. 3. This figure shows a graded cell honeycomb structure, similar to that described in U.S. Pat. No. 4,154,568. In FIG. 3, the diameters of the cells increase in the upstream direction. That is, there are shown honeycombs 50, 51 and 52, of gradually increasing size, which together form overall honeycomb 20. It can also be said that the size of the cells decreases in the direction of flow of gas.

The honeycomb configuration of FIG. 3 radiates heat upstream most effectively. Because of the increasing cell diameter, the hot surfaces within the honeycomb can radiate heat in the upstream direction along unobstructed straight lines. For catalytic combustors located above ground, the incoming fuel air mixture can be preheated by heat exchange with the outgoing combustion gas. This is difficult in the tight confines of an oil well; back radiation from the catalytic honeycomb is thus one way to preheat the incoming fuel-air mixture.

In the embodiment of FIG. 1, the length of the combustion chamber should be much greater than the width, even more so than is shown. Making the chamber longer allows the incoming fuel to be pre-heated for a longer time, before entering the catalyst support.

It is understood that many variations may be made to the embodiments described herein, within the scope of the invention. The choice of fuel used, the particular ignition means present, and the arrangement of the nozzles are examples of features which are subject to modification. These and other variations are intended to be covered by the following claims.

What is claimed is:

1. Apparatus for generating a mixture of steam and combustion gas downhole in an oil well, comprising:

means defining a chamber, means for injecting fuel and air into the chamber, means for thermally combusting fuel downstream of the injecting means, a catalyst support, positioned downstream of the thermal combusting means, the support being coated with a catalyst, the catalyst being suitable to support catalytic combustion of the fuel, and means for mixing water with combustion gas upstream of the catalyst support.

2. The apparatus of claim 1, wherein the catalyst support is a honeycomb, and wherein the catalyst support extends substantially across the width of the chamber-defining means, and across the path of the combustion gas.

3. The apparatus of claim 2, wherein the honeycomb is made of metal.

4. The apparatus of claim 3, further comprising means for igniting the fuel.

5. The apparatus of claim 3, wherein the honeycomb comprises a plurality of cells of graded sizes, wherein the sizes of the cells decrease in the direction of flow of combustion gas.

6. The apparatus of claim 5, further comprising second means for mixing water with combustion gas, located downstream of the catalyst support.

7. The apparatus of claim 6, wherein the catalyst support is positioned a sufficient distance from the fuel-injecting means to allow pre-heating of the fuel.

8. Apparatus for generating a mixture of steam and combustion gas downhole in an oil well, comprising:

means defining a chamber, means for injecting fuel and air into the chamber, means for thermally combusting fuel downstream of the injecting means, a catalyst support, positioned downstream of the thermal combusting means, the support being coated with a catalyst, the catalyst being suitable to support catalytic combustion of the fuel, the support comprising a stack of spaced apart rings, positioned to allow the flow of gas through the rings and out of the chamber, and means for mixing water with combustion gas upstream of the catalyst support.

9. The apparatus of claim 8, further comprising means for mixing water with combustion gas downstream of the catalyst support.

10. The apparatus of claim 9, wherein the catalyst support is made of metal.

11. The apparatus of claim 10, further comprising second means for mixing water with combustion gas, downstream of the catalyst support.

12. The apparatus of claim 11, wherein the catalyst support is positioned a sufficient distance from the fuel-injecting means to allow pre-heating of the fuel.

13. The apparatus of claim 12, further comprising means for igniting the fuel.

14. A method of generating a mixture of steam and combustion gas downhole in an oil well, comprising the steps of:

injecting fuel and air into a combustion chamber, igniting the fuel and air mixture, thereby creating a flame, temporarily stopping the flow of fuel into the chamber so as to extinguish the flame, resuming the flow of fuel, mixing water with the combustion gas, continuing combustion by catalytic combustion of the gas while passing the gas through a catalyst-coated support and out of the chamber, the support being coated with a catalyst suitable to support catalytic combustion of the fuel.

15. The method of claim 14, further comprising the step of mixing more water with the combustion gas, after the gas has passed through the support.

* * * * *